US007658343B2

(12) United States Patent
Potts

(10) Patent No.: US 7,658,343 B2
(45) Date of Patent: Feb. 9, 2010

(54) DRUM CONSTRUCTION FOR A MINERAL BREAKER

(75) Inventor: Alan Potts, Somercotes (GB)

(73) Assignee: MMD Design & Consultancy Limited (GB)

( * ) Notice: Subject to any disclaimer, the term of this patent is extended or adjusted under 35 U.S.C. 154(b) by 690 days.

(21) Appl. No.: 11/430,309

(22) Filed: May 8, 2006

(65) Prior Publication Data

US 2006/0266854 A1 Nov. 30, 2006

Related U.S. Application Data

(63) Continuation of application No. PCT/GB2004/004665, filed on Nov. 5, 2004.

(30) Foreign Application Priority Data

Nov. 8, 2003 (GB) ..... 0326155.9
Nov. 8, 2003 (GB) ..... 0326157.5

(51) Int. Cl.
*B02C 13/02* (2006.01)

(52) U.S. Cl. ..... 241/158; 241/187; 241/189.1; 241/236

(58) Field of Classification Search ..... 241/158, 241/187, 236, 189.1
See application file for complete search history.

(56) References Cited

U.S. PATENT DOCUMENTS 3,578,252 A * 5/1971 Brewer ..... 241/141
4,799,627 A 1/1989 Potts
6,024,312 A 2/2000 Spiesshofer

FOREIGN PATENT DOCUMENTS

EP 0167178 A2 12/1982
EP 0167178 A3 12/1982
EP 0114725 A2 1/1984
EP 0114725 A3 1/1984
EP 0246775 11/1987
JP 2001046901 A 10/2000
SU 1794473 A1 2/1992
WO WO 89/04719 A1 6/1989
WO WO 02/060588 A1 8/2002

* cited by examiner

*Primary Examiner*—Bena Miller
(74) *Attorney, Agent, or Firm*—Nikolai & Mersereau, P.A.; Thomas J. Nikolai

(57) ABSTRACT

A mineral breaker including a pair of breaker drum assemblies rotatably housed in a housing with their axes parallel, each drum assembly including circumferentially extending groups of teeth, the groups being spaced axially along the drum assembly to define a circumferentially extending channel between adjacent circumferential groups of teeth, the drum assemblies being arranged such that each circumferential group of teeth on one drum assembly is located to enter a circumferentially extending channel between a pair of neighboring circumferential groups of teeth on the other drum assembly, the cross-sectional shape and size of each tooth and channel being complementary such that the sides and tip of a tooth when entering a channel are closely spaced from the sides and bottom of the channel, and an elongate breaker bar extending longitudinally in a direction parallel to the axes of the drum assemblies, the breaker bar being located with its longitudinal axis positioned inbetween and beneath the axes of rotation of the drum assemblies, the breaker bar including a plurality of breaker teeth spaced along its length, each breaker tooth of the breaker bar projecting upwardly into a channel defined between a pair of circumferential groups of teeth on one of the drum assemblies, each breaker tooth being of a size and shape complementary to the channel into which it projects so as to be closely spaced from the sides and bottom of the channel.

20 Claims, 11 Drawing Sheets

DRUM CONSTRUCTION FOR A MINERAL BREAKER

CROSS REFERENCE TO RELATED APPLICATION

This application is a continuation of prior PCT Application PCT/GB2004/004665, filed 5 Nov. 2004.

BACKGROUND OF THE INVENTION

Field of the Invention

The present invention relates to a mineral breaker, in particular but not exclusively to a mineral breaker capable of a high sizing reduction ratio and also to a drum construction for a mineral breaker.

SUMMARY OF THE INVENTION

According to one aspect of the invention there is provided a mineral breaker including a pair of breaker drum assemblies rotatably housed in a housing with their axes parallel, each drum assembly including circumferentially extending groups of teeth, the groups being spaced axially along the drum assembly to define a circumferentially extending channel between adjacent circumferential groups of teeth, the drum assemblies being arranged such that each circumferential group of teeth on one drum assembly is located to enter a circumferentially extending channel between a pair of neighbouring circumferential groups of teeth on the other drum assembly, the cross-sectional shape and size of each tooth and channel being complementary such that the sides and tip of a tooth when entering a channel are closely spaced from the sides and bottom of the channel, and an elongate breaker bar extending longitudinally in a direction parallel to the axes of the drum assemblies, the breaker bar being located with its longitudinal axis positioned inbetween and beneath the axes of rotation of the drum assemblies, the breaker bar including a plurality of breaker teeth spaced along its length, each breaker tooth of the breaker bar projecting upwardly into a channel defined between a pair of circumferential groups of teeth on one of the drum assemblies, each breaker tooth being of a size and shape complementary to the channel into which it projects so as to be closely spaced from the sides and bottom of the channel.

In accordance with another aspect of the present invention there is provided a drum construction for a mineral breaker, the drum construction including a drive shaft and a plurality of toothed annuli mounted on the drive shaft, adjacent annuli being axially spaced along the shaft, each annulus being fixedly connected to the shaft by welding at least a portion of the annulus to at least a part of an adjacent exposed circumferential portion of the shaft.

Preferably adjacent annuli are axially spaced apart along the shaft to expose a circumferential portion of the shaft therebetween.

In a particular embodiment, each annulus is axially spaced from its neighbouring annulus so as to define an open topped annular channel in which the bottom of the channel is defined by the exposed circumferential portion of the shaft and opposed sides of the channel are defined by opposed axial end faces of the neighbouring toothed annuli, the channel being filled with weld to weldingly secure the annuli to said shaft.

Preferably each toothed annulus includes an annular boss and a row of teeth spaced circumferentially about the boss, each tooth extending generally radially from the boss. The number of teeth in the row is preferably in the range of 3 to 8.

Each toothed annulus may be a unitary metal casting or forging or profile cast from metal plate wherein the teeth are integrally joined with the annular boss. Each tooth may define a breaker tooth per se. Alternatively each tooth may define an inner core or horn of a breaker tooth wherein the outer shape of the breaker tooth is defined by a tooth sheath or wear plates secured to the horn.

Preferably for each toothed annulus wherein each tooth defines a breaker tooth per se, the ratio of the radial height of the tooth tip relative to the maximum axial width of the tooth is approximately 2:1 and the ratio of the height of the tooth tip relative to the radius of the toothed annulus is approximately 1:2. Preferably the ratio of the shaft diameter relative to the diameter of the annulus is 1:2 or more, more preferably about 1:2.2 and the ratio of the radial height of the tooth tip (as measured from the peripheral surface of the shaft) relative to the diameter of the shaft is 1:about 1.7 or less, more preferably 1:about 1.6.

According to another aspect of the invention there is provided a mineral breaker including a breaker drum construction as defined above.

According to another aspect of the present invention there is provided a mineral breaker including a pair of breaker drum constructions as defined above rotatably housed in a housing with their axes parallel, the drum constructions being arranged such that each toothed annulus on one drum is located inbetween a pair of neighbouring annuli on the other drum.

DESCRIPTION OF THE DRAWINGS

Various aspects of the present invention are hereinafter described by way of example with reference to the accompanying drawings, in which:—

DESCRIPTION OF THE PREFERRED EMBODIMENT

Figure 1:
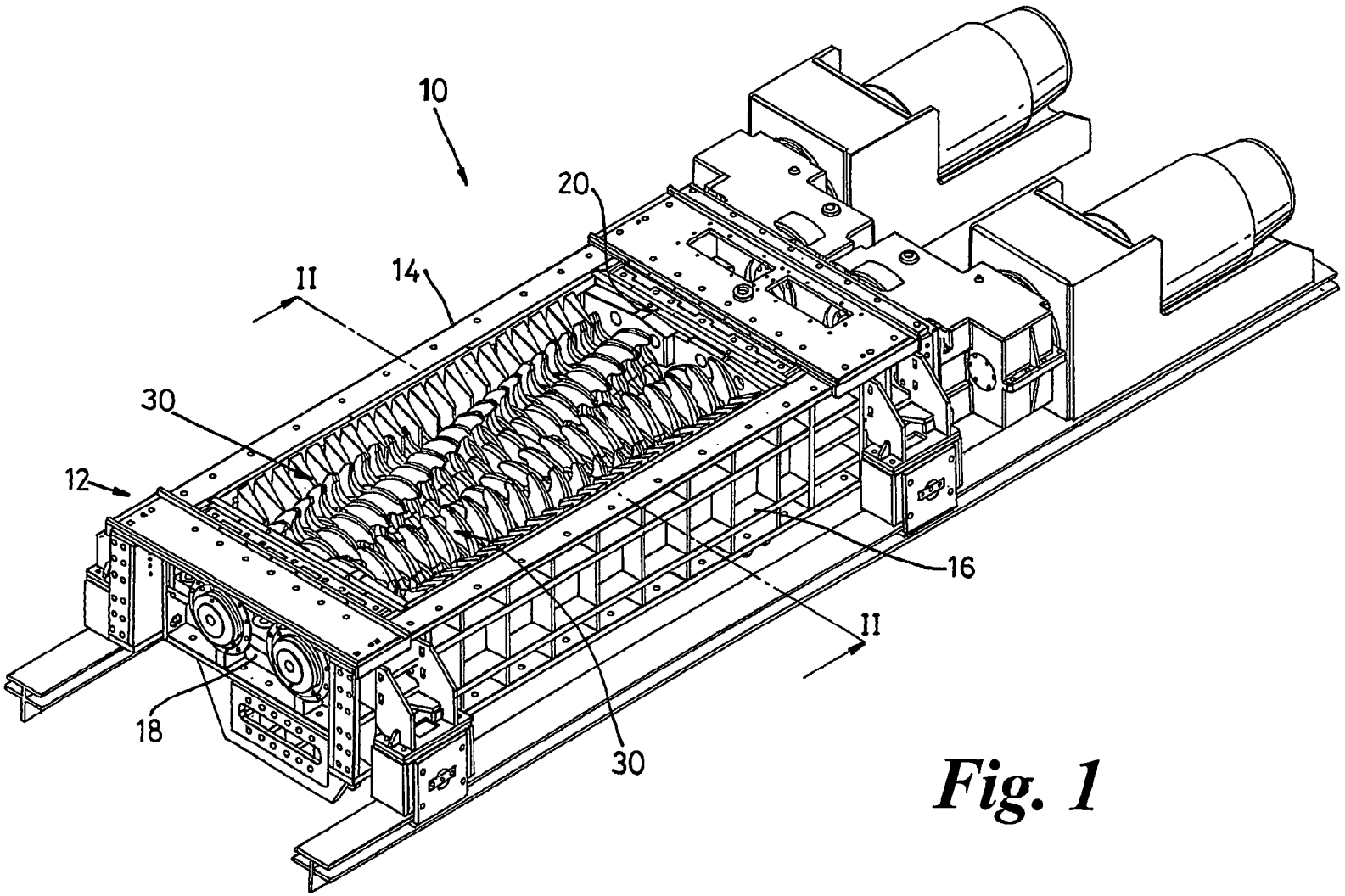
FIG. 1 is a perspective view from above of a mineral breaker according to an embodiment of the present invention.

A mineral breaker according to an embodiment of the present invention is shown generally at 10 in FIG. 1.

The breaker 10 includes a box-like housing 12 having opposed side walls 14, 16 and opposed end wall assemblies 18, 20.

A pair of breaker drum assemblies 30 are rotatably mounted in the housing 12 so as to extend longitudinally from one end wall assembly 18 to the other end wall assembly 20.

Each breaker drum assembly 30 includes a shaft 31 which is rotatably mounted at opposite ends in respective end wall assemblies 18, 20 via bearings. The shaft 31 is preferably of solid section and is preferably formed from a suitable steel.

Figure 9:
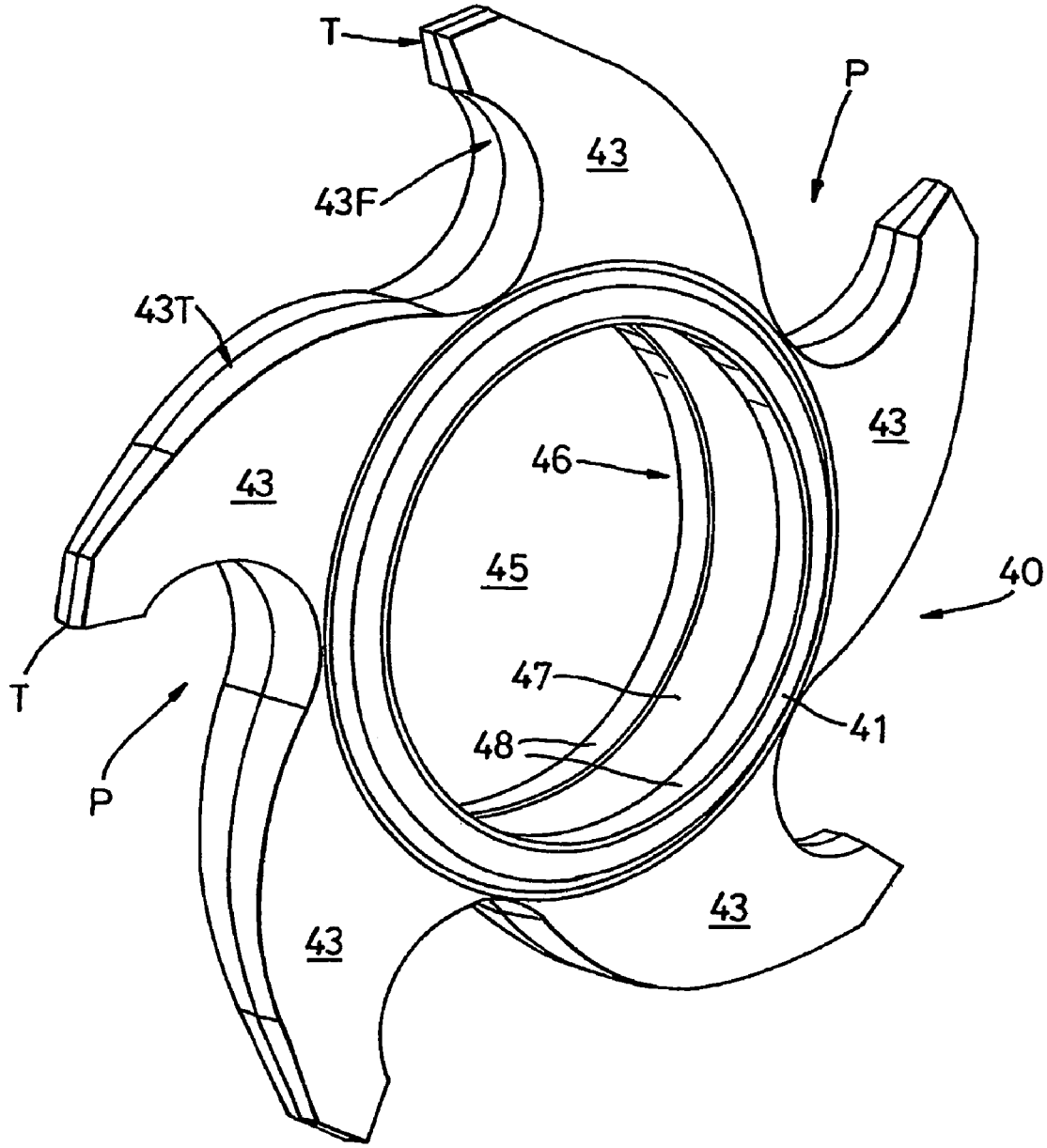
FIG. 9 is a perspective view of a toothed annulus of the mineral breaker shown in FIG. 1.

Each breaker drum assembly 30 further includes a plurality of toothed annuli 40 of disc-like form. As shown in FIG. 9, each toothed annulus 40 includes an annular boss 41 from which a plurality of teeth 43 radially project; the teeth 43 per se defining breaker teeth. Preferably the annular boss 41 and breaker teeth 43 are formed in one-piece such that the toothed annulus 40 is of a unitary construction with the teeth 43 being integrally connected with the boss 41. Each tooth 43 has a leading face 43F which extends upwardly from the outer circumferential periphery of the boss 41 to a tooth tip T and a trailing face 43T which extends downwards from the tooth tip T to merge with the leading face 43F of the succeeding tooth 43. There is thereby defined a series of material accommodating pockets P (FIG. 9) on each annulus 40, each pocket P being defined between the leading face 43F of one tooth 43 and the trailing face 43T of the preceding tooth 43.

Preferably each toothed annulus 40 is located on a shaft 31 (FIG. 2) and is fixedly secured thereto by welding as will be described below.

One advantage of fixedly securing the annuli 40 to the shaft 31 by welding is the avoidance of keyways both in the annuli and shaft. This avoids localised stress weakness in both the annuli and shaft created by the provision of keyways and also enables the difference in diameter size between the annulus boss 41 and shaft diameter to be relatively small; in other words a relatively large diameter shaft 31 can be accommodated in a given diameter size of tooth annulus 40. This has the significant advantage of enabling a relatively large diameter shaft to be used which thereby enables a relative large amount of torque or load to be transmitted to the breaker teeth 43.

Figure 2:
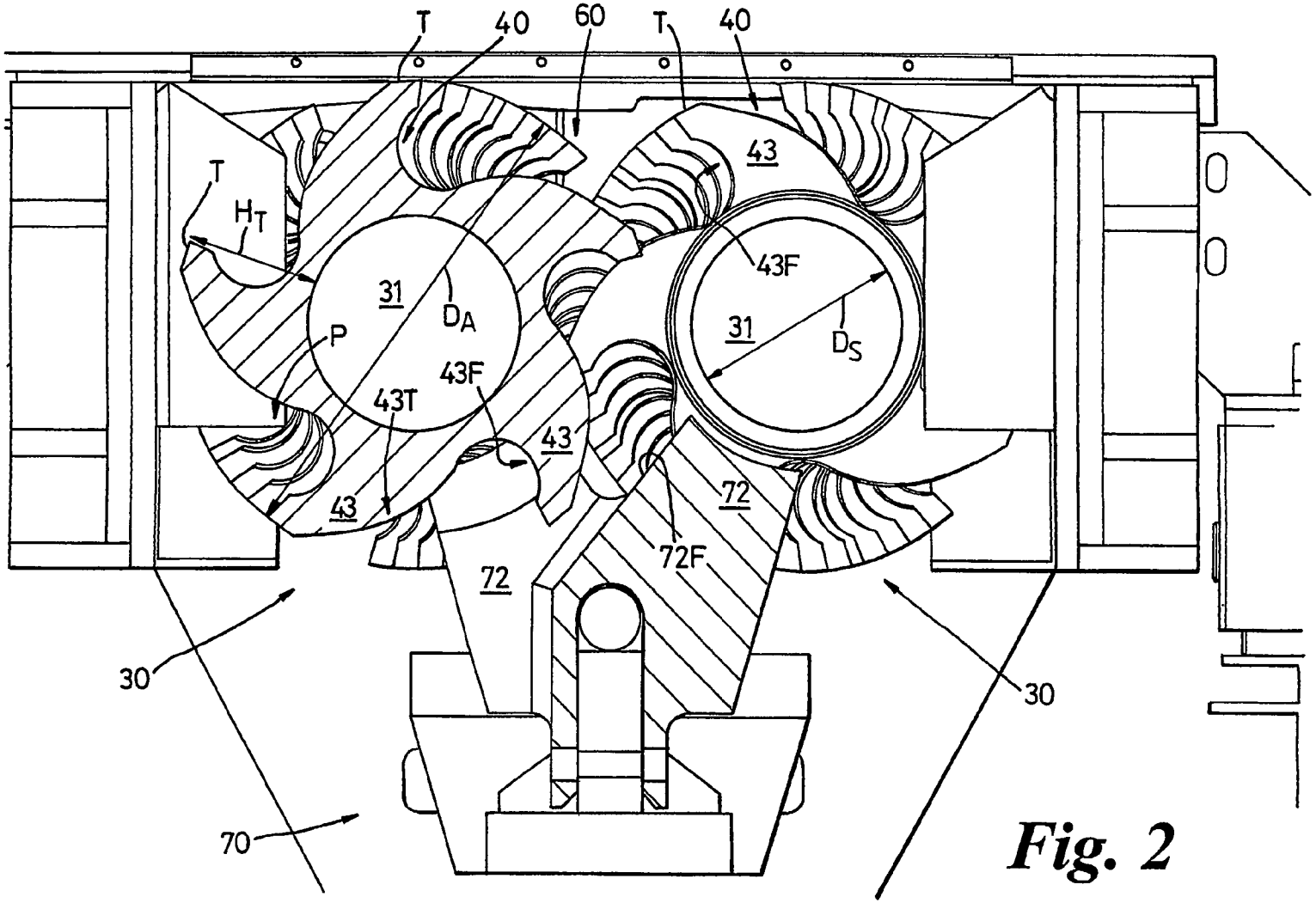
FIG. 2 is a part cross-sectional view taken along line II-II in FIG. 1.
Figure 3:
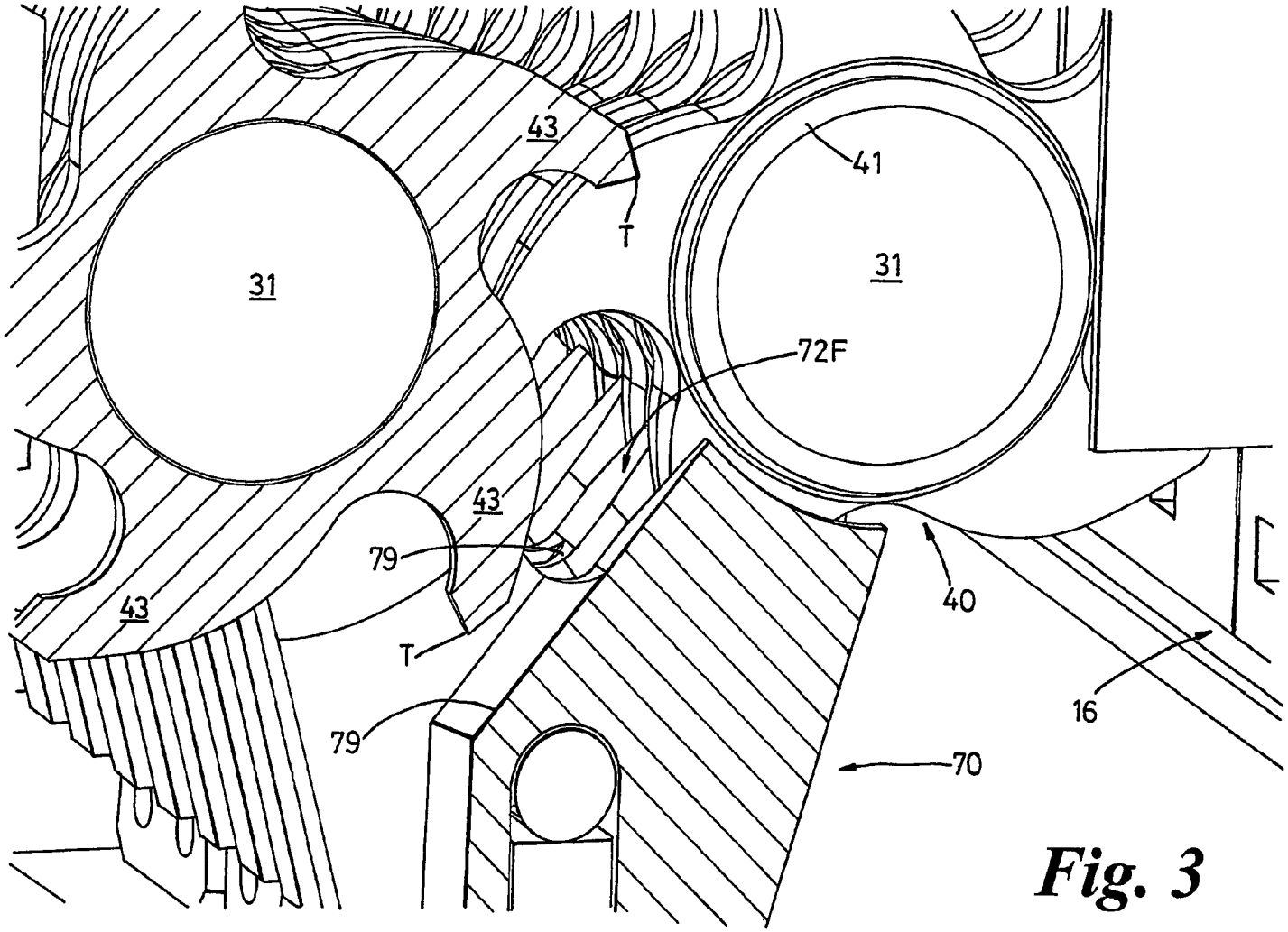
FIG. 3 is a sectional view along line II-II shown in perspective.

As shown, by way of illustration in FIG. 2, the ratio of the diameter $D_S$ of the shaft relative to the diameter $D_A$ of the annulus 40 is about 1:2.2 and the ratio of the radial height $H_T$ of the tooth tip T of tooth 43 (as measured from the periphery of the shaft 31) to the diameter $D_S$ of the shaft is about 1:1.6. In other words the tooth height $H_T$ is greater than the radius of the shaft 31.

In the embodiment of FIGS. 1 to 9, each toothed annulus 40 is a casting or forging formed from a suitable metal which is capable of being welded to the shaft 31.

As shown in FIG. 9, all the teeth 43 are arranged in a single row which extends circumferentially around the boss 41. The teeth 43 are equally spaced about the circumference of boss 41. In the illustrated embodiment, there are five teeth 43 in the row, it is to be appreciated that the number of teeth 43 in the row may be in the range of 3 to 8 teeth.

To enable the toothed annulus 40 to be received on shaft 31, the boss 41 is provided with a through bore 45. The diameter of bore 45 is the same as the external diameter of shaft 31. To enable the toothed annulus 40 to positively seat upon the shaft 31 without rocking (caused by slight differences of size due to tolerances of manufacture) the inner wall 46 of the boss 41 which defines the bore 45 is preferably provided with an annular recess 47 to thereby define two axially spaced apart raised annular seats 48 of relatively shortly axial extent. Accordingly, the toothed annulus 40 seats upon the shaft 31 only via the axially spaced annular seats 48.

Figure 8:
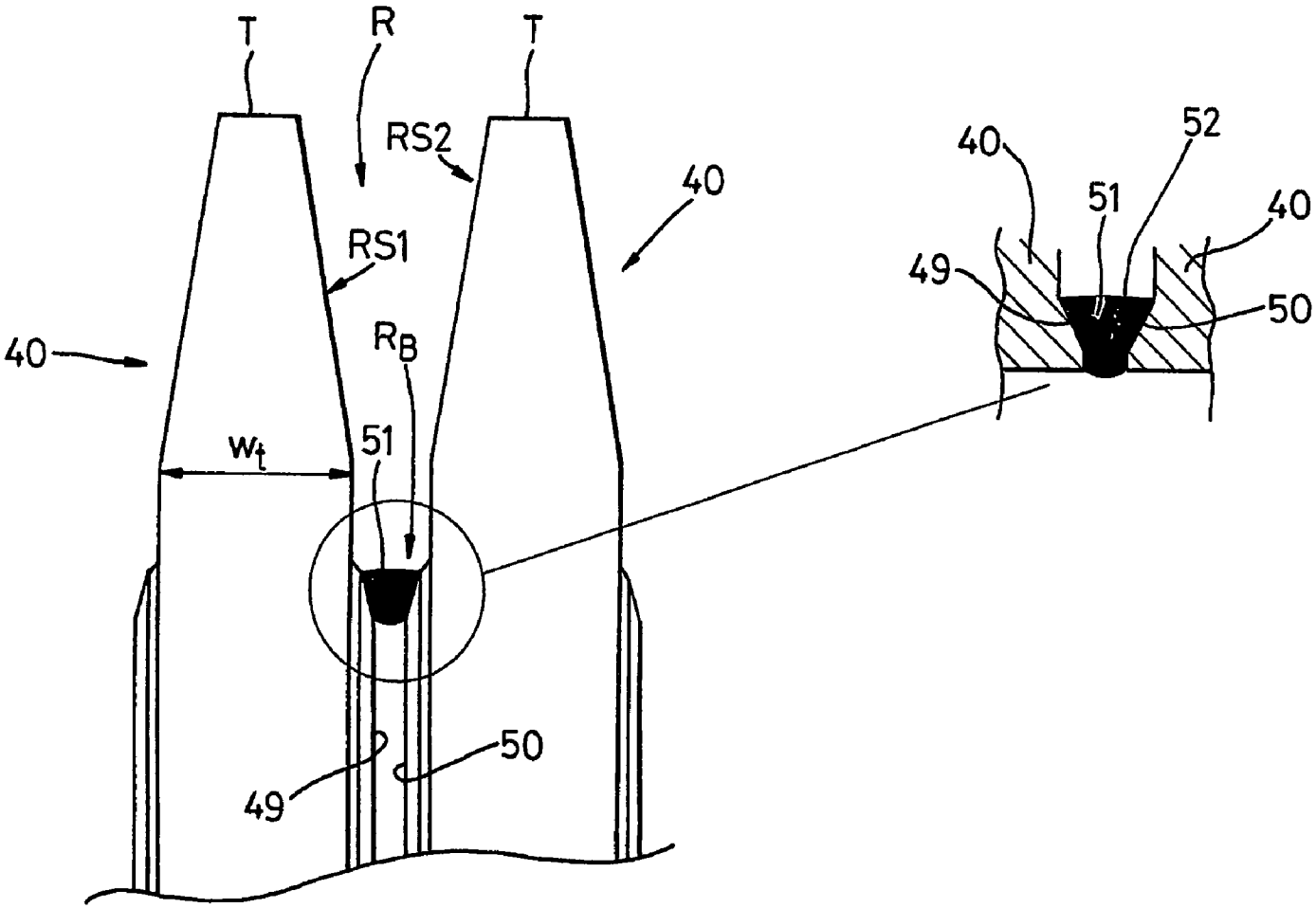
FIG. 8 is an axial section through a pair of adjacent toothed annuli mounted on a shaft.

As illustrated more clearly in FIG. 8, to fixedly secure the toothed annuli 40 to the shaft 31, adjacent annuli 40 are spaced apart long the shaft 31 such that opposed axial end faces 49, 50 of neighbouring annuli 40 define a gap therebetween with a circumferential portion of the shaft 31 being exposed by the gap. In other words, adjacent annuli 40 are spaced axially apart such that an open topped annular channel is formed therebetween in which the opposed sides of the channel are defined by opposed axial end faces 49, 50 and the bottom of the channel is defined by the exposed circumferential portion of the shaft 31. The channel defines a welding receptor and enables each end face 49, 50 to be welded to the exposed portion of the shaft 31; in practice this means that the channel is filled with weld 51 which is preferably machined to define a smooth solid top face 52 for the channel.

As indicated above, the annuli 40 are of disc-like form (i.e. the axial dimension of each annulus relative to its diameter is small, and the row of teeth on each annulus have substantially planar side faces which collectively define substantially planar axial side faces of a disc).

Accordingly, by arranging the annuli 40 side by side on shaft 31 a series of annular channels R along the breaker drum are formed, the sides RS1, RS2 of each channel R being defined by facing axial side faces of each pair or neighbouring annuli 40 and the bottom $R_B$ of the channel R being defined collectively by the outer circumferential face of the bosses 41 and weld face 52. The effective working height h of each tooth 43 is the height of its tip above the bottom $R_B$ of the neighbouring channel R (hereinafter the effective working height h of each tooth 43 is referred to as the 'drum height' h of the tooth. The drum height h of each tooth 43 is necessarily less than the height $H_T$ due to the intermediate provision of the boss 41 which is required for securing the teeth 43 to the shaft 31 (as well as providing a protective covering for the shaft 31). Accordingly the smaller the radial thickness of boss 41, the greater the possible drum height h of the teeth 43. As indicated above, welding of the boss 41 directly to the shaft 31 enables the radial thickness of the boss 41 to be kept to a minimum and so this capability can be utilised to maximise the drum height h of the teeth 43. This is advantageous as it enables relatively tall teeth 43 to be provided and so provides the breaker with the capability of gripping large mineral lumps contained in the in-feed of material.

Preferably, the rotary position of a given toothed annulus 40 relative to its neighbour is off-set by a predetermined increment such that the teeth on the annuli 40 on a given shaft extend along a predetermined helical path in order to define a series of discrete scrolls of teeth as disclosed in our European patent 0167178.

In the illustrated machine, the increment by which adjacent annuli 40 are off-set is such that the starting point of each discrete scroll at one end of the drum assembly is off-set from the finishing point of the scroll at the other end of the drum assembly by an angular distance equivalent to two teeth pitch spacings between teeth 43. In the illustrated embodiment, the angular off-set increment between adjacent annuli 40 is 6°.

Figure 10:
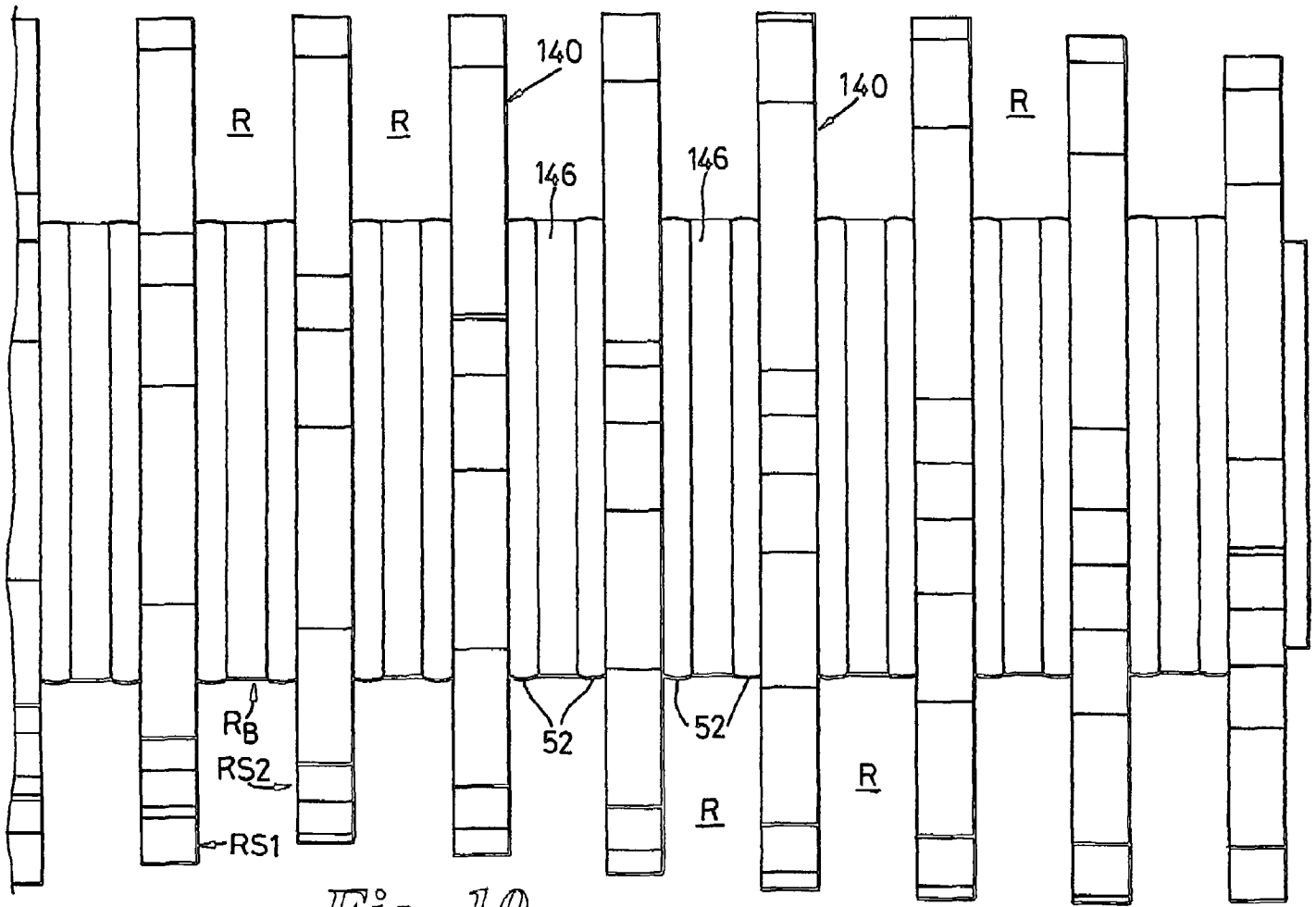
FIG. 10 is a plan view of part of a breaker drum assembled from toothed annuli according to a further embodiment of the present invention.
Figure 11:
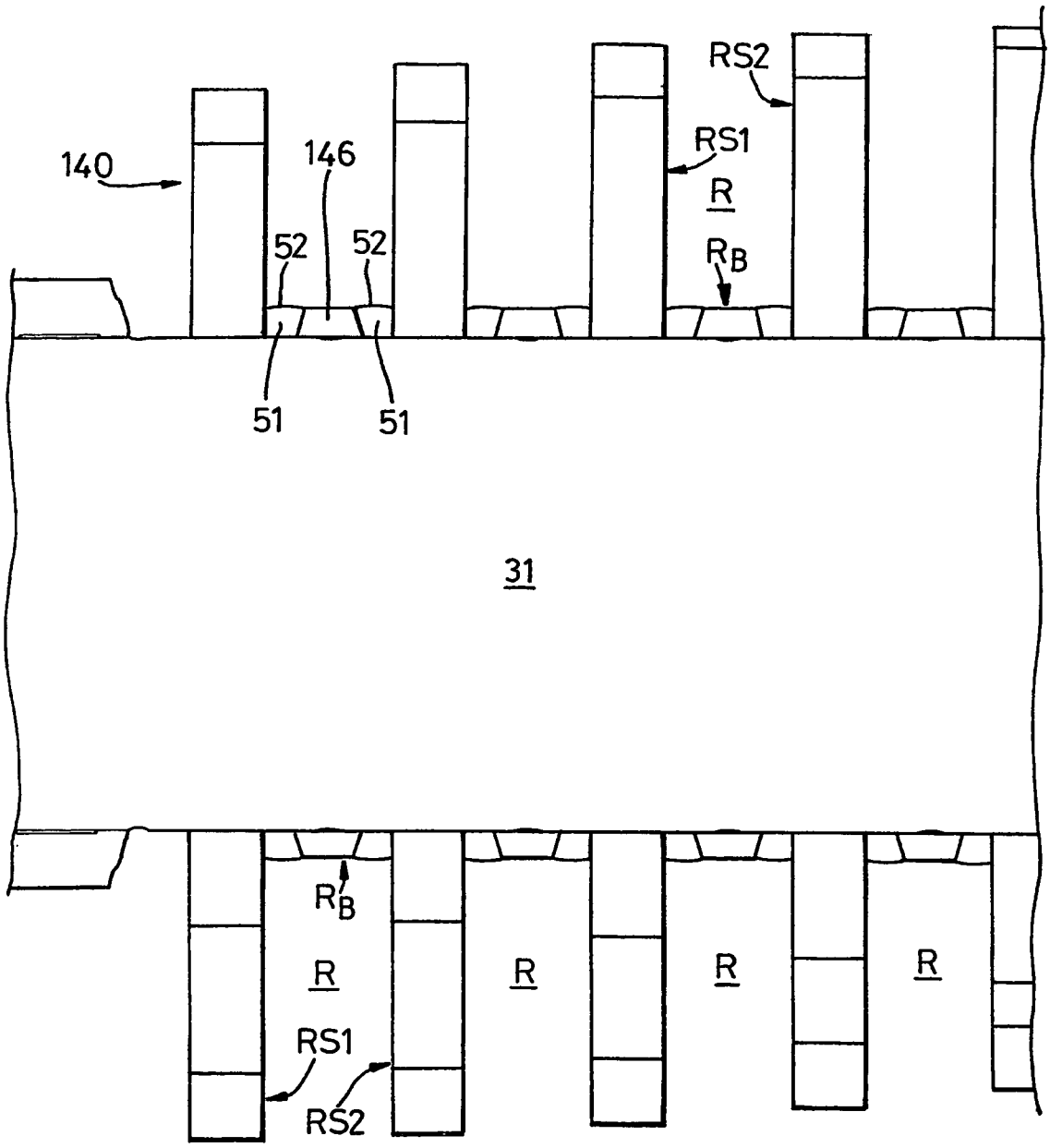
FIG. 11 is an axial section through the breaker drum of FIG. 10.

An alternative toothed annulus 140 for use in the mineral breaker of the present invention is illustrated in FIGS. 10 and 11. Parts similar to those in FIGS. 1 to 9 have been designated by the same reference numerals.

The toothed annulus 140, instead of being a metal forging or casting, is formed from a suitable metal plate preferably by profile cutting. Forming the toothed annulus 140 from metal plate has several advantages including ease and consistency of manufacture and improved breaking performance of the teeth derived from absence of forging/casting faults within the metal grain structure.

The toothed annulus 140 includes a through bore 145 to enable it to be slid onto shaft 31. Adjacent annuli 140 are spaced apart, preferably by an intermediate spacing ring 146. The intermediate spacing ring 146 is axially spaced from the annuli 140 between which it is located in order to define an open topped annular channel therebetween which acts as a welding receptor for weld 51. Accordingly, annuli 140 are weldingly secured to shaft 31 in a similar manner to annuli 40. In the embodiment of FIGS. 10, 11 the outer circumferential face of spacer rings 146 and outer face 52 of welding 51 collectively define the channel bottom $R_B$.

One aim of a mineral breaker according to the illustrated embodiment of the invention is to provide a mineral breaker which is capable of breaking down relatively large lumps of mineral to a relative small size of lump. For example, a machine 10 having a distance of 625 mm between the axes of the drum assemblies 30 is expected to be capable of breaking down lumps of about 0.6 meter cubed down to a lump size having a maximum dimension of about 150 mm.

In order for the machine to be capable of gripping relative large lumps of mineral, it is necessary for the drum height h of the teeth relative to the outer diameter of the annulus to be relatively large. This is illustrated diagrammatically in FIG. 6 wherein the mineral breaker includes drum assemblies 30 having axes of rotation separated by a distance of about 625 mm and toothed annuli having an outer diameter of about 780 mm, each tooth having a drum height h of about 175 mm as measured from the outer diameter of the boss 41 (which defines the recess bottom $R_B$) and the tip T of the tooth 43.

With such an arrangement the gap 60 defined between the tips of two opposed teeth 43 is shown as having a width W of about 625 mm and a depth d of about 160 mm (the depth d being defined as the height of the tip of a tooth above the bottom of the gap 60 as defined by the trailing faces 43T of the preceding tooth 43). In other words, gap 60 enables relatively large lumps of mineral to be grippingly received between opposed teeth 43 to permit a primary breaking action to be performed on the mineral lump in accordance with the principles of breaking discussed in our European patent 0167178.

In the above example, the ratio of the drum height h relative to the radius of the tooth annulus 40 is approximately 1:2.2.

It is envisaged however that the ratio of the drum height h of a tooth 43 relative to the radius of the annulus 40 may be varied in order to achieve different sizes of gap 60.

In this respect it is expected that this ratio will be in the range of about 1:2.5 to 1:1.5.

In order to achieve a relatively small size of broken lump emerging from the mineral breaker, it is necessary for the axial dimension of channel R between adjacent annuli 40 to be relatively small which also requires the width $w_t$ of the teeth 43 to be relatively small and preferably be of a width dimension which is less than a maximum dimension of the desired broken lumps to be achieved.

Figure 6:
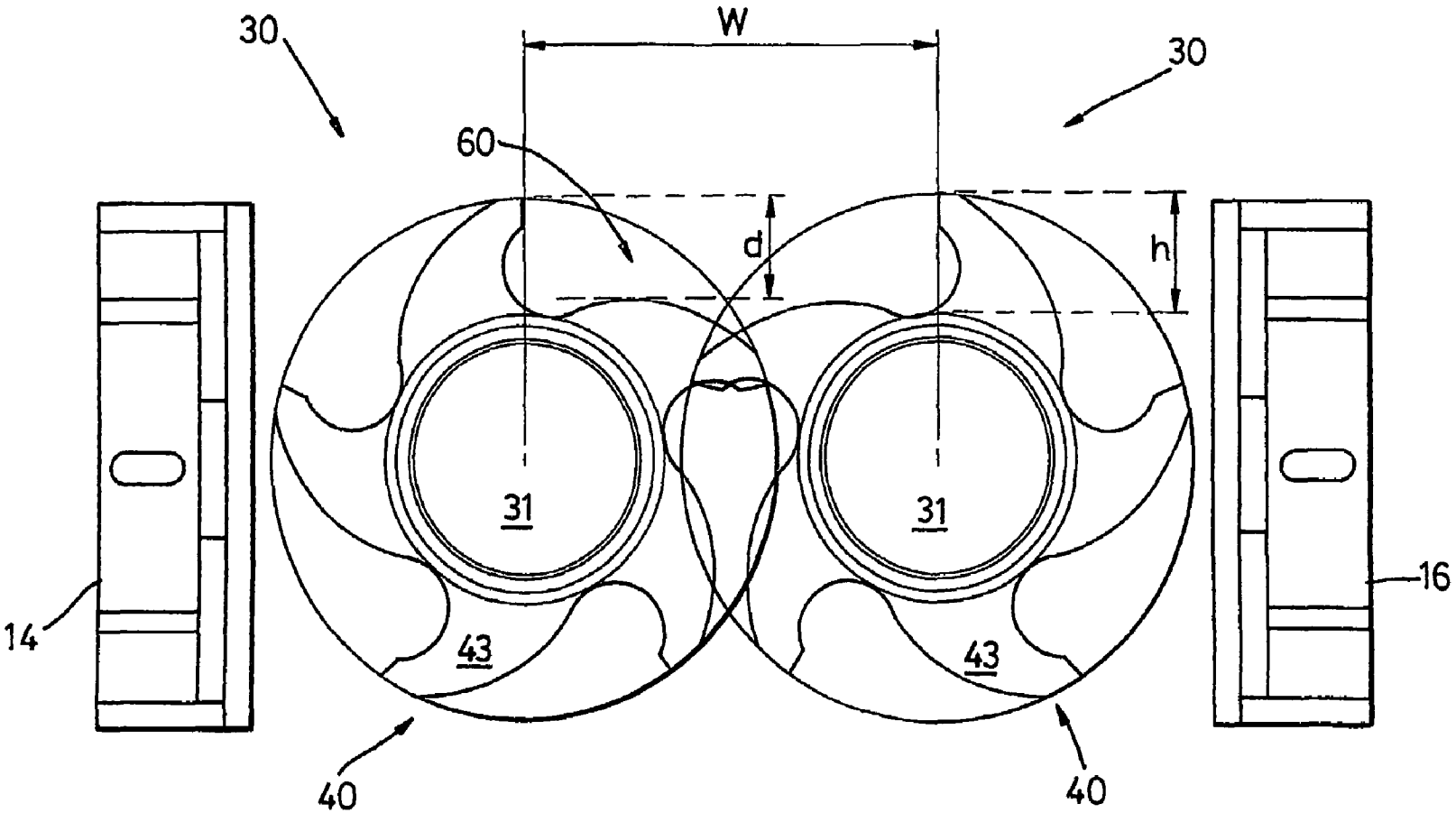
FIG. 6 is a schematic end view illustrating the relative rotational positions of a pair of opposed toothed annuli.

In the mineral breaker 10 illustrated in FIG. 6, the maximum width $w_t$ of each tooth 43 at its base is chosen to be about 85 mm. With the tooth tapering to its tip T which has a width of approximately 27 mm. In the embodiment of FIG. 10, the plate thickness from which the annuli 140 are cut is about 70 mm.

With such an arrangement each tooth 43 on one drum assembly acts to break lumps down by a snapping action by forcing mineral lumps downwardly through the channel R defined between two adjacent teeth 43 on the opposed drum assembly.

Figure 7:
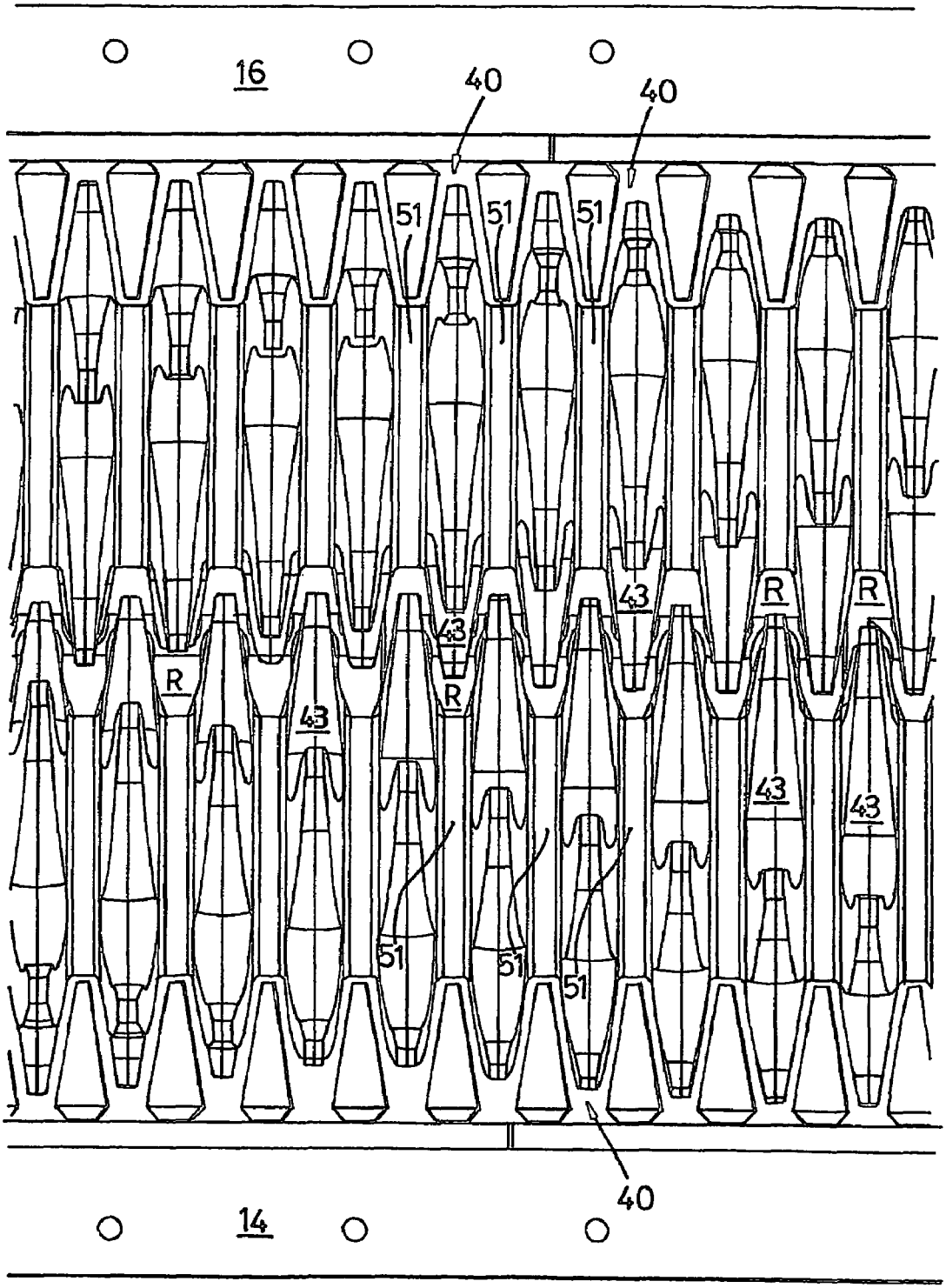
FIG. 7 is a part detail plan view of the mineral breaker shown in FIG. 1.

As seen in FIG. 7, the dimensions of each channel R in the longitudinal direction of the drum assemblies, will determine the maximum size dimension of the broken lump in the longitudinal direction of the mineral breaker.

Preferably the relative cross-sectional size and shape of each tooth 43 and the channel R through which it sweeps during rotation of the drum assemblies are such that the tooth 43 at least the front and trailing faces 43F, 43T (and preferably the sides of each tooth) are closely spaced with the sides of the channel R. This helps to ensure that material passing between the breaker drums predominantly has to be passed through the pockets P inbetween adjacent teeth on a given annulus 40, 140 rather than being allowed to pass through gaps between an annulus and the sides/bottom of a channel R in which it is located.

With the above arrangement, it will be appreciated that a mineral lump seated in the pocket P between two adjacent teeth 43 on the same annulus 40 may have a dimension in excess of the desired maximum lump dimension in the direction of rotation of the annulus 40 after a tooth 43 has forced the lump through the channel R on the opposed drum assembly.

In order to ensure that such a lump is broken down further, the mineral breaker preferably includes a breaker bar assembly 70 located beneath the drum assemblies 30. The provision of breaker bar assembly 70 also ensures that long thin lumps of mineral extending longitudinally of the drum assemblies cannot pass through without being broken down.

Figure 4:
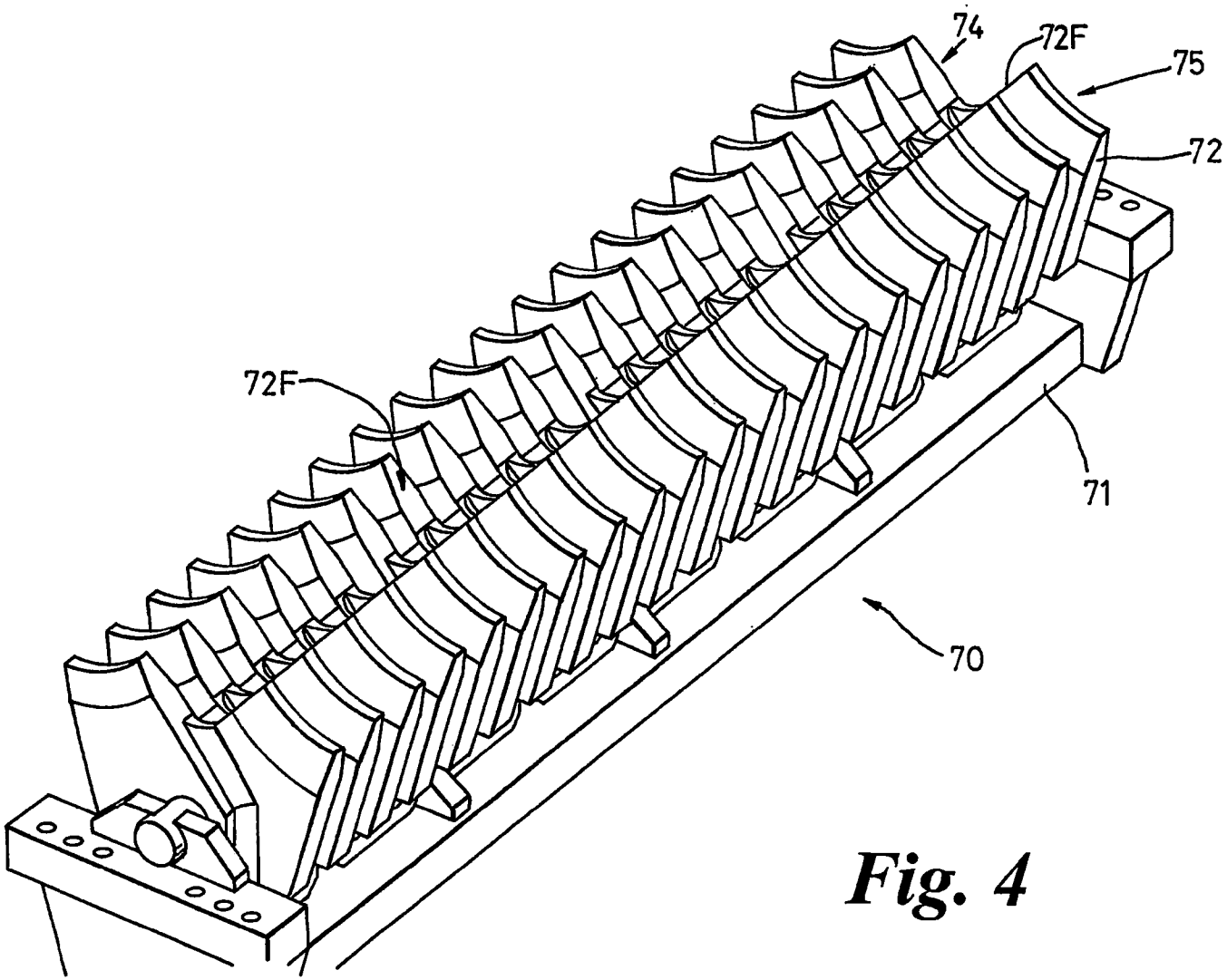
FIG. 4 is a perspective view from above of the breaker bar assembly.
Figure 5:
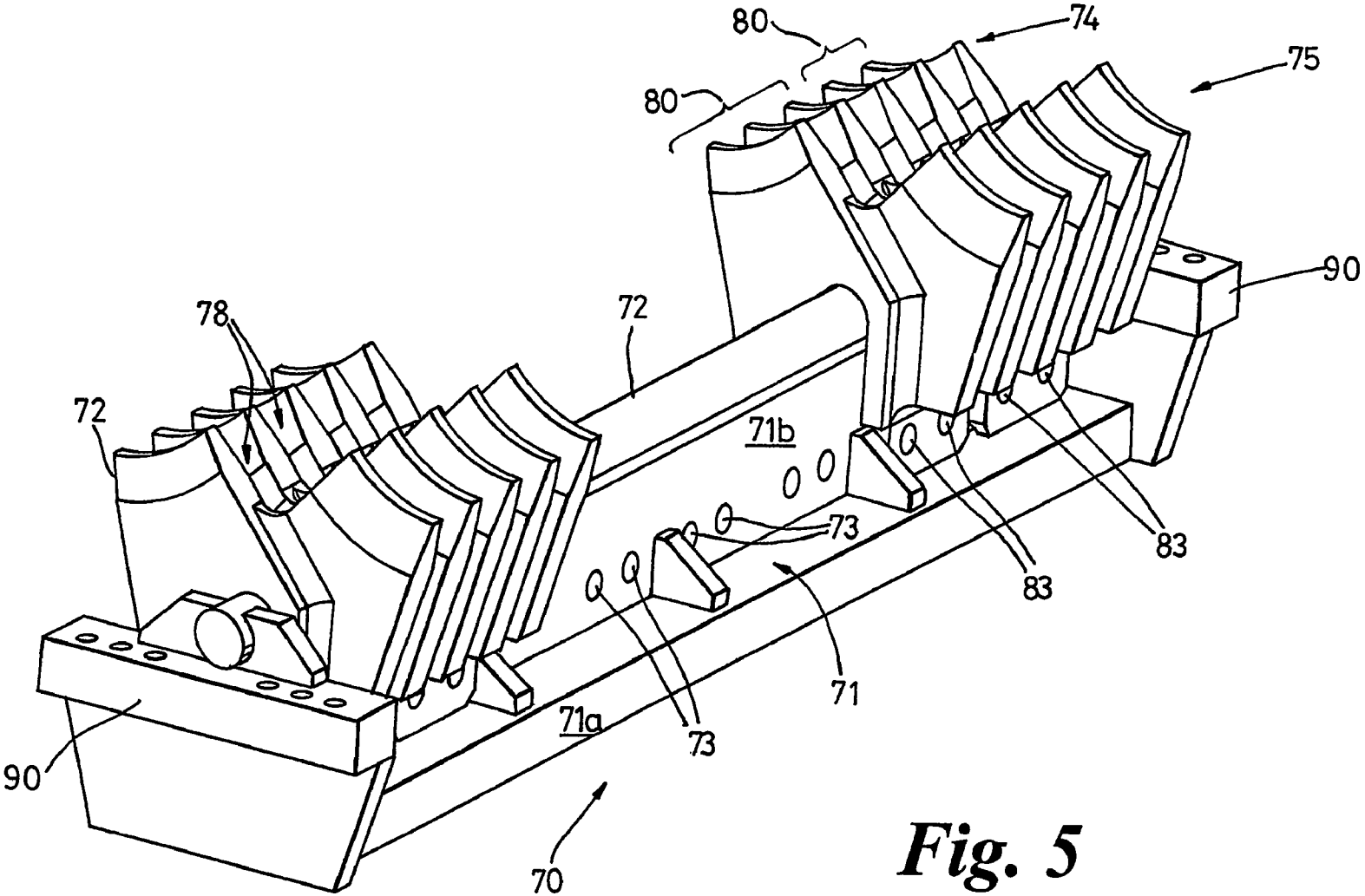
FIG. 5 is a similar view to FIG. 4 showing the breaker teeth removed.

The breaker bar assembly 70 as illustrated in FIGS. 4 and 5 is elongate and extends longitudinally in a direction parallel to, and centrally located between, the axes of rotation of the drum assemblies 30.

The breaker bar assembly 70 includes a main elongate support body 71 which is secured at each end to a respective end wall assembly 18, 20 of housing 12. The body 71 is of generally 'T' shaped cross-section having a horizontal part 71*a* and a vertical part 71*b*. Preferably a strengthening bar 72 extends along the upper edge of the vertical part 71*b*.

The body 71 has mounted thereon a plurality of breaker teeth 72.

The breaker teeth 72 are each of blade like form and project upwardly into the annular recess R defined between adjacent toothed annuli 40, 140 on one drum.

The cross-sectional shape and size of each tooth 72 is similar to that of channel R so that each tooth 72, in cross-section substantially fills channel R. This has the effect of enabling the leading face 72F of teeth 72 to act as scrapers to clear material adhering between adjacent annuli 40; this is particularly useful when handling sticky materials such as clays or tar sand.

In addition since each tooth 72 substantially fills each channel R, the teeth 72 on the breaker bar act to choke flow of material emerging from between the drum assemblies 30. This has the effect of agitating material emerging from between the drum assemblies 30 and so assist in dislodging any oversized lumps located inbetween adjacent teeth 41 on the same annulus 40. These oversized lumps are then broken down further by interaction between breaker teeth 41 and adjust teeth 72 between which it passes.

As seen in FIGS. 4 and 5, the teeth 72 are arranged in two longitudinally extending rows 74, 75 wherein the teeth 72 in one row co-operate with one drum assembly 30 and the teeth 72 in the other row co-operate with the other drum assembly 30.

Teeth 72 in a given row are spaced apart in the longitudinal direction of support 71 to define a groove or recess 78 through which the teeth 41 on an associated tooth annulus 40 pass during rotation of the drum assembly 30. The groove 78 has sides defined by opposed sides of adjacent teeth 72 on one row and a bottom 79 defined by a side edge of an intermediate tooth 72 from the other row. The bottom 79 at the mouth entrance to groove 78 is preferably closely spaced from the tip T of teeth 41 passing into groove 78 so as to reduce the available pocket size in which an oversize lump may be accommodated between the leading face of one tooth 41 and the trailing face of an adjacent tooth 41 on the same annulus 40.

Preferably the teeth 72 are formed in blocks of teeth 80 which straddle the vertical part 71*b* of the elongate support 71 and are secured thereto by through bolts (not shown) passing through bores 73 formed in the vertical part 71*b* and bores 83 formed in blocks 80. Preferably the blocks 80 are each cast from a suitable metal and each comprise a number of teeth 72 for forming one row 74 and a number of teeth 72 for forming the other row 75. Conveniently the number of teeth 72 in each block 80 is five with three teeth 72 on one side and two teeth 72 on the other side. Thus by mounting adjacent blocks 80 on the vertical part 71*b* with alternate blocks 80 having three teeth 72 on one side of part 71*b* and two teeth 72 on the other side of part 71*b* it is possible to create the two rows of teeth 74, 75.

The elongate body 71 is preferably provided with mounting flanges 90 at each end via which the breaker bar assembly 70 may be mounted on the opposed end walls 18, 20 of the breaker housing.

It is envisaged that the height of the breaker bar assembly 70 relative to the drum assemblies 30 may be adjusted by the placement of shims beneath flanges 90. This enables the terminal edges 72*a* of teeth 71 to be closely spaced relative to the bottom of recess R and also enables bottom 79 at the mouth entrance to grooves 78 to be closely spaced relative to tips T of teeth 41.

In the examples described in FIGS. 1 to 11, the teeth 43 per se of each annulus 40 define a breaker tooth. It is envisaged that the teeth 43 may instead define the core or horn to which a tooth cap or wear plate may be attached to define the breaker tooth. Examples of breaker teeth having a core or horn and a covering cap are described in our EP patent 0167178.

The invention claimed is:

1. A mineral breaker including a pair of breaker drum assemblies rotatably housed in a housing with their axes parallel, each drum assembly including a cylindrical shaft with circumferentially extending groups of teeth, the groups being spaced axially along the drum assembly to define a circumferentially extending channel between adjacent circumferential groups of teeth, the drum assemblies being arranged such that each circumferential group of teeth on one drum assembly is located to enter a circumferentially extending channel between a pair of neighboring circumferential groups of teeth on the other drum assembly, the cross-sectional shape and size of each tooth and channel being complementary such that the sides and tip of a tooth when entering a channel are closely spaced from the sides and bottom of the channel, and an elongate breaker bar extending longitudinally in a direction parallel to the axes of the drum assemblies, the breaker bar being located with its longitudinal axis positioned inbetween and beneath the axes of rotation of the drum assemblies, the breaker bar including a plurality of breaker teeth spaced along its length, each breaker tooth of the breaker bar projecting upwardly into a channel defined between a pair of circumferential groups of teeth on one of the drum assemblies, each breaker tooth being of a size and shape complementary to the channel into which it projects so as to be closely spaced from the sides and bottom of the channel to thereby substantially fill the channel from its periphery to its bottom.

2. A mineral breaker according to claim 1 wherein each drum assembly includes a drive shaft and a plurality of toothed annuli mounted on the drive shaft, adjacent annuli being spaced apart along the shaft, each annulus being fixedly connected to the shaft by welding at least a portion of the annulus to at least a part of an adjacent exposed circumferential portion of the shaft.

3. A mineral breaker according to claim 2 wherein each breaker drum assembly tooth has a drum height h which is at least twice the maximum width dimensions of the tooth, the ratio of drum height h of each tooth to the radius of the annuls being in the range of about 1:1.5 to about 1:2.5.

4. A mineral breaker according to claim 3 wherein for each toothed annulus, the ratio of the radial height of the tip of each tooth, as measured from the periphery of the shaft, relative to the diameter of the shaft is 1:1.7 or less.

5. A mineral breaker according to claim 3 wherein adjacent annuli are spaced apart to expose a circumferential portion of the shaft therebetween.

6. A mineral breaker according to claim 5 wherein each annulus is axially spaced from its neighboring annulus so as to define an open topped annular channel in which the bottom of the channel is defined by the exposed circumferential portion of the shaft and opposed sides of the channel are defined by opposed axial end faces of the neighboring toothed annuli, the channel being filled with weld to weldingly secure the annuli to said shaft.

7. A mineral breaker according to claim 6 wherein for each toothed annulus, the ratio of the radial height of the tip of each tooth, as measured from the periphery of the shaft, relative to the diameter of the shaft is 1:1.7 or less.

8. A mineral breaker according to claim 5 wherein for each toothed annulus, the ratio of the radial height of the tip of each tooth, as measured from the periphery of the shaft, relative to the diameter of the shaft is 1:1.7 or less.

9. A mineral breaker according to claim 3 wherein each toothed annulus is a profile cut disc formed from metal plate.

10. A mineral breaker according to claim 2 wherein adjacent annuli are spaced apart to expose a circumferential portion of the shaft therebetween.

11. A mineral breaker according to claim 10 wherein each annulus is axially spaced from its neighboring annulus so as to define an open topped annular channel in which the bottom of the channel is defined by the exposed circumferential portion of the shaft and opposed sides of the channel are defined by opposed axial end faces of the neighboring toothed annuli, the channel being filled with weld to weldingly secure the annuli to said shaft.

12. A mineral breaker according to claim 11 wherein for each tooth annulus, the ratio of the shaft diameter relative to the diameter of the annulus is 1:2 or more.

13. A mineral breaker according to claim 11 wherein for each toothed annulus, the ratio of the radial height of the tip of each tooth, as measured from the periphery of the shaft, relative to the diameter of the shaft is 1:1.7 or less.

14. A mineral breaker according to claim 2 wherein each toothed annulus includes an annular boss and a row of breaker teeth spaced circumferentially about the boss, each tooth extending generally radially from the boss.

15. A drum construction according to claim 14 wherein the number of teeth in the row is in the range of 3 to 8.

16. A mineral breaker according to claim 2 wherein each toothed annulus is a profile cut disc formed from metal plate.

17. A drum construction according to claim 16 wherein the number of teeth in a row is in a range of 3-8.

18. A mineral breaker according to claim 2 wherein for each tooth annulus, the ratio of the shaft diameter relative to the diameter of the annulus is 1:2 or more.

19. A mineral breaker according to claim 18 wherein for each toothed annulus, the ratio of the radial height of the tip of each tooth, as measured from the periphery of the shaft, relative to the diameter of the shaft is 1:1.7 or less.

20. A mineral breaker according to claim 1 wherein the plurality of breaker teeth each are contoured to conform to the contour of the cylindrical shafts of said drum assemblies.

* * * * *